US010760200B2

(12) United States Patent
Choi et al.

(10) Patent No.: US 10,760,200 B2
(45) Date of Patent: Sep. 1, 2020

(54) WATER SUPPLY DEVICE AND WASHING MACHINE HAVING THE SAME

(71) Applicant: Samsung Electronics Co., Ltd., Suwon-si (KR)

(72) Inventors: Young Min Choi, Yongin-si (KR); Young-Hyun Kim, Suwon-si (KR); Do Haeng Kim, Suwon-si (KR); Min Hwan Oh, Suwon-si (KR); Won Jae Han, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 290 days.

(21) Appl. No.: 15/373,692

(22) Filed: Dec. 9, 2016

(65) Prior Publication Data

US 2017/0167069 A1 Jun. 15, 2017

(30) Foreign Application Priority Data

Dec. 9, 2015 (KR) ..... 10-2015-0174820

(51) Int. Cl.
*D06F 39/08* (2006.01)

(52) U.S. Cl.
CPC ..... *D06F 39/083* (2013.01); *D06F 2202/085* (2013.01); *D06F 2204/084* (2013.01); *D06F 2204/086* (2013.01)

(58) Field of Classification Search
CPC ..... D06F 39/083; D06F 2202/085; D06F 2204/086
See application file for complete search history.

(56) References Cited

U.S. PATENT DOCUMENTS 3,822,571 A * 7/1974 Waugh ..... D06F 39/02 68/17 R
3,856,036 A * 12/1974 Drews ..... D06F 39/088 137/216.1
3,975,931 A * 8/1976 Bischkopf ..... D06F 39/02 68/17 R
4,700,554 A * 10/1987 Eichman ..... D06F 39/02 137/268
5,473,914 A * 12/1995 Pyo ..... D06F 39/02 68/17 R (Continued)

FOREIGN PATENT DOCUMENTS

CN 102086582 6/2011
CN 103898717 7/2014

(Continued)

OTHER PUBLICATIONS

Chinese Office Action dated May 29, 2020 in Chinese Patent Application No. 201611122620.8.

*Primary Examiner* — Joseph L. Perrin
*Assistant Examiner* — Irina Graf
(74) *Attorney, Agent, or Firm* — Staas & Halsey LLP

(57) ABSTRACT

A water supply device includes a housing that has an inlet and an outlet, and an inflow chamber that is provided inside the housing and communicates with the inlet. A discharge chamber is provided inside the housing and communicates with the inflow chamber and the outlet. A buffer chamber is provided inside the housing and communicates with the discharge chamber, and a blocking rib extends from an inner side of the housing and is provided to partition the discharge chamber from the buffer chamber.

20 Claims, 17 Drawing Sheets

(56) References Cited

U.S. PATENT DOCUMENTS

| | | | | |
|---|---|---|---|---|
| 8,074,476 | B2 * | 12/2011 | Quandt | D06F 39/02 68/17 R |
| 2012/0125055 | A1 * | 5/2012 | Lee | D06F 39/02 68/17 R |
| 2012/0204606 | A1 * | 8/2012 | Buso | D06F 39/02 68/17 R |
| 2014/0109620 | A1 * | 4/2014 | Yoon | D06F 39/088 68/12.18 |
| 2014/0352804 | A1 * | 12/2014 | Bolduan | D06F 39/02 137/343 |
| 2015/0059418 | A1 * | 3/2015 | Lee | D06F 37/267 68/17 R |
| 2015/0337480 | A1 * | 11/2015 | Lee | D06F 39/02 68/17 R |

FOREIGN PATENT DOCUMENTS

| | | | | |
|---|---|---|---|---|
| EP | 2216437 | A1 * | 8/2010 | D06F 25/00 |
| EP | 2924161 | | 9/2015 | |
| JP | 2008067903 | A * | 3/2008 | D06F 39/08 |
| JP | 2011240078 | A * | 12/2011 | D06F 39/088 |
| KR | 1020070036809 | * | 4/2007 | D06F 39/02 |

* cited by examiner

WATER SUPPLY DEVICE AND WASHING MACHINE HAVING THE SAME

CROSS-REFERENCE TO RELATED APPLICATION

This application claims the benefit of Korean Patent Application No. 10-2015-0174820, filed on Dec. 9, 2015 in the Korean Intellectual Property Office, the disclosure of which is incorporated herein by reference.

BACKGROUND

1. Field

Embodiments of the present disclosure relate to a water supply device, and more particularly, to a water supply device that is capable of controlling water pressure.

2. Description of the Related Art

A washing machine is a machine that washes clothes using power, and generally includes a tub that stores washing water, a rotating tub that is rotatably installed inside the tub, and a pulsator that is provided to be rotatable at the bottom of the rotating tub.

In the washing machine, a washing space is generally formed by the tub and the rotating tub, but there is no space for separately washing stained socks, white clothes, underwear, and the like.

In addition, washing water should be supplied to the washing machine through a water supply device in order to do laundry, and in this instance, water pressure of the supplied washing water is greater than necessary and a problem in that the washing water splashes around a desired point rather than being discharged thereto occurs.

Meanwhile, since tension caused by the washing water occurs at an outlet of the water supply device because there is no pressure difference between an inlet and the outlet when the supply of the washing water is stopped, a part of the washing water may remain inside the water supply device without being discharged from the water supply device. Such residual water inside the water supply device may be frozen inside the water supply device in winter and cause the water supply device to be frozen and broken.

SUMMARY

Therefore, it is an aspect of the present disclosure to provide a water supply device which may prevent the water supply device from being frozen and broken due to residual water existing therein when a supply of water is stopped, and a washing machine having the same.

It is another aspect of the present disclosure to provide a water supply device which may form an air pocket therein to prevent freeze-breakage due to an expansion in volume of residual water, and a washing machine having the same.

It is still another aspect of the present disclosure to provide a water supply device which may discharge residual water existing therein when a supply of water is stopped, and a washing machine having the same.

Additional aspects of the disclosure will be set forth in part in the description which follows and, in part, will be obvious from the description, or may be learned by practice of the disclosure.

In accordance with one aspect of the present disclosure, a water supply device includes: a housing that has an inlet and an outlet; an inflow chamber that is provided inside the housing and communicates with the inlet; a discharge chamber that is provided inside the housing and communicates with the inflow chamber and the outlet; a buffer chamber that is provided inside the housing and communicates with the discharge chamber; and a blocking rib that extends from an inner side of the housing and is provide to partition the discharge chamber from the buffer chamber.

Here, the blocking rib may extend from an inner side of the housing that is adjacent to the inflow chamber.

Also, at least one end portion of the blocking rib may be spaced apart from an inner surface of the housing to form a buffer hole through which the discharge chamber and the buffer chamber communicate.

Also, the blocking rib may be provided at a position corresponding to a height of residual water remaining inside the discharge chamber when a supply of water is stopped.

Also, the blocking rib may be provided to extend along a direction perpendicular to a direction of gravity.

Also, the buffer chamber may be provided at an upper portion of the discharge chamber along a direction of gravity.

Also, the water supply device may further include a water pressure adjusting rib that extends from the inner side of the housing and is provided to partition the inflow chamber from the discharge chamber.

Also, the water pressure adjusting rib may be spaced apart from a lower surface of the housing to form a water pressure adjusting hole through which the inflow chamber and the discharge chamber communicate.

Also, the water pressure adjusting rib may include an air pocket hole that is formed to pass therethrough so that a part of an air pocket generated in the buffer chamber is moved to the inflow chamber.

Also, the air pocket hole may include a plurality of slits.

Also, an outlet guide rib may be provided at the outlet, the outlet guide rib may extend along a discharge direction of water and guides water discharged from the discharge chamber.

In accordance with another aspect of the present disclosure, a water supply device includes: a housing that has an inlet and an outlet; an inflow chamber that is provided inside the housing and communicates with the inlet; a discharge chamber that is provided inside the housing and communicates with the inflow chamber and the outlet; a buffer chamber that is provided inside the housing and communicates with the discharge chamber; and a water pressure adjusting rib that extends from an inner side of the housing and is provided to partition the inflow chamber from the discharge chamber, wherein the water pressure adjusting rib includes an air pocket hole through which the discharge chamber and the inflow chamber communicate.

In accordance with still another aspect of the present disclosure, a washing machine includes: a cabinet; a main washing space that is provided inside the cabinet and has a tub in which washing water is stored and a rotating tub in which laundry is disposed inside the tub; an auxiliary washing space that is provided to be separate from the main washing space; and a water supply device that supplies washing water to the auxiliary washing space, wherein the water supply device includes a housing that has an inlet and an outlet and includes an inflow chamber communicating with the inlet, a discharge chamber communicating with the inflow chamber and the outlet, and a buffer chamber communicating with the discharge chamber and provided in an upper portion of the discharge chamber, a blocking rib that is provided to partition the discharge chamber from the buffer chamber, and a water pressure adjusting rib that partitions the inflow chamber from the discharge chamber and in which an air pocket hole formed so that the inflow chamber and the discharge chamber communicate is provided.

Here, the water pressure adjusting rib may be spaced apart from a lower surface of the housing to form a water pressure adjusting hole provided to move water introduced through the inlet from the inflow chamber to the discharge chamber.

Also, the water supply device may be configured to be supplied with water from a water supply source, and the washing machine further includes a residual water drainage member that is provided at a flow passage between the water supply source and the water supply device and in which a residual water drainage hole for discharging residual water existing in the water supply device when the supply of water is stopped is formed.

Also, the residual water drainage member may be disposed at a position lower than that of the water supply device in a direction of gravity.

Also, the residual water drainage member may include an inflow pipe through which water is introduced from the water supply source and an outflow pipe through which the water introduced through the inflow pipe is discharged to the water supply device, and the residual water drainage hole is provided at a flow passage between the inflow pipe and the outflow pipe.

Also, the residual water drainage member may include a venturi portion in which a cross-sectional area of the flow passage is reduced, and the residual water discharge hole is formed at a portion of the residual water drainage member at which the venturi portion is formed.

Also, the residual water drainage member may supply water passing through the venturi portion together with outside air introduced through the residual water drainage hole to the water supply device when supplying water.

Also, the residual water drainage hole may be configured to discharge the residual water existing in the water supply device to the main washing space when the supply of water is stopped.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
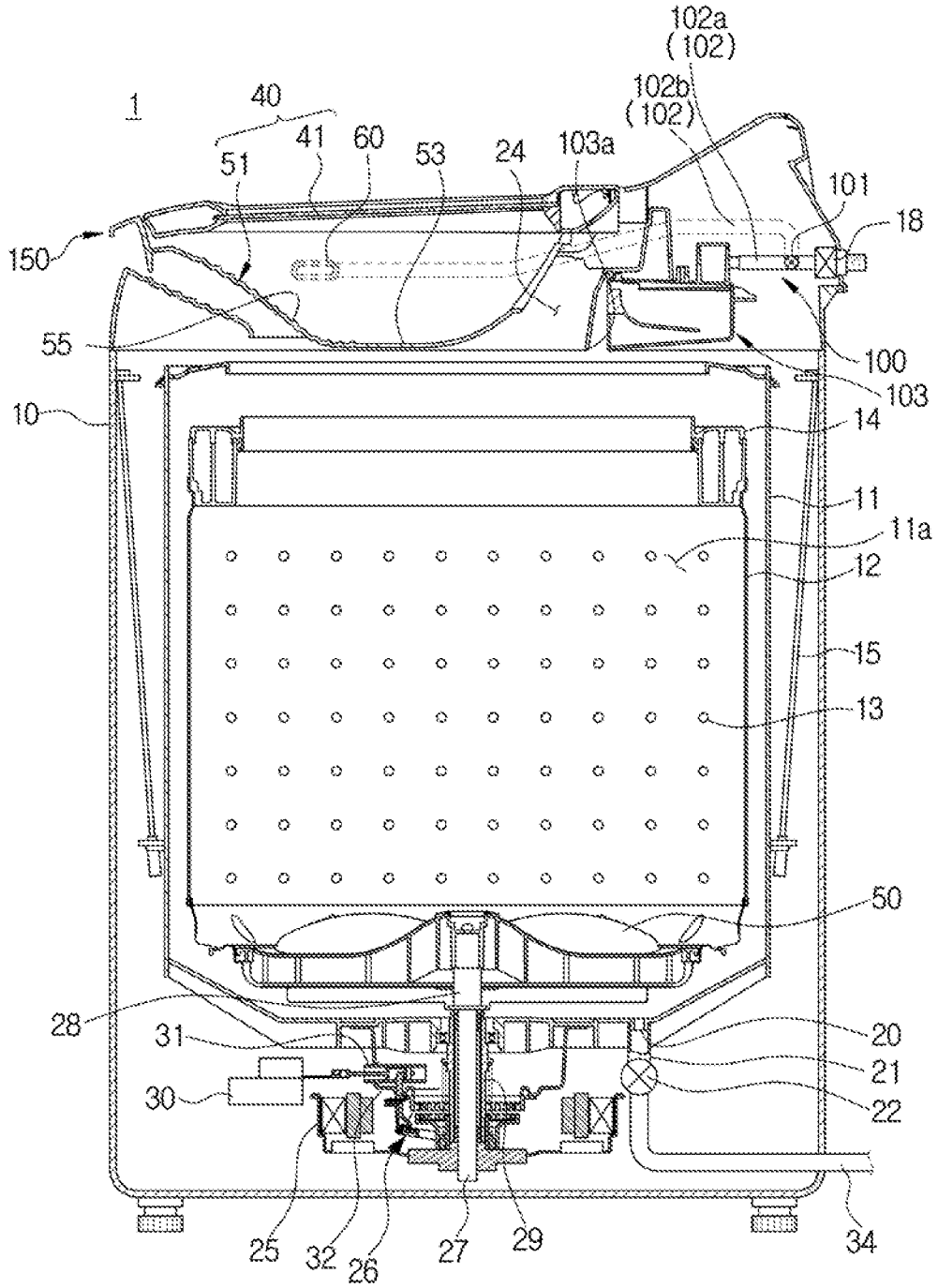
FIG. 1 is a cross-sectional view showing a washing machine according to an embodiment of the present invention.

The embodiments described in the specification and the configurations shown in the drawings are simply the most preferable examples of the present invention and are not intended to illustrate all aspects of the spirit of the present invention. As such, it should be understood that various equivalents and modifications can be made to replace the examples at the time of filing of the present application.

In addition, in the specification and the drawings, since the same reference numerals will be given to the components having substantially the same functional configurations.

The terms used in the present specification are used just for explaining certain embodiments, and are not intended to limit the present inventive concept. A singular form involves a plural form as long as it is not differently defined in the context. In this specification, it will be appreciated that "comprise", "have" or the like terms are just used for designating the presence of feature, numerals, steps, operations, elements, parts or combinations thereof, without excluding possibility of the presence or addition of one or more features, numerals, steps, operations, elements, parts or combinations thereof.

The terms such as 'first' and/or 'second', etc. can be used in explaining various elements, but the elements have not to be limited by the foregoing terms. The above terms have to be given only for distinguishing one element from another element, and for example, a first element may be named a second element, and vice versa, without departing from the scope of the present inventive concept. The term 'and/or' means one or all of the listed elements or a combination of any two or more of the listed elements.

Meanwhile, terms used in the following description such as "distal end," "rear end," "upper portion," "lower portion," "upper end," "lower end," and the like are defined based on the drawings, and the shape and position of each component are not limited by these terms.

Hereinafter, preferred embodiments of the present invention will be described in detail with reference to the accompanying drawings.

Figure 2:
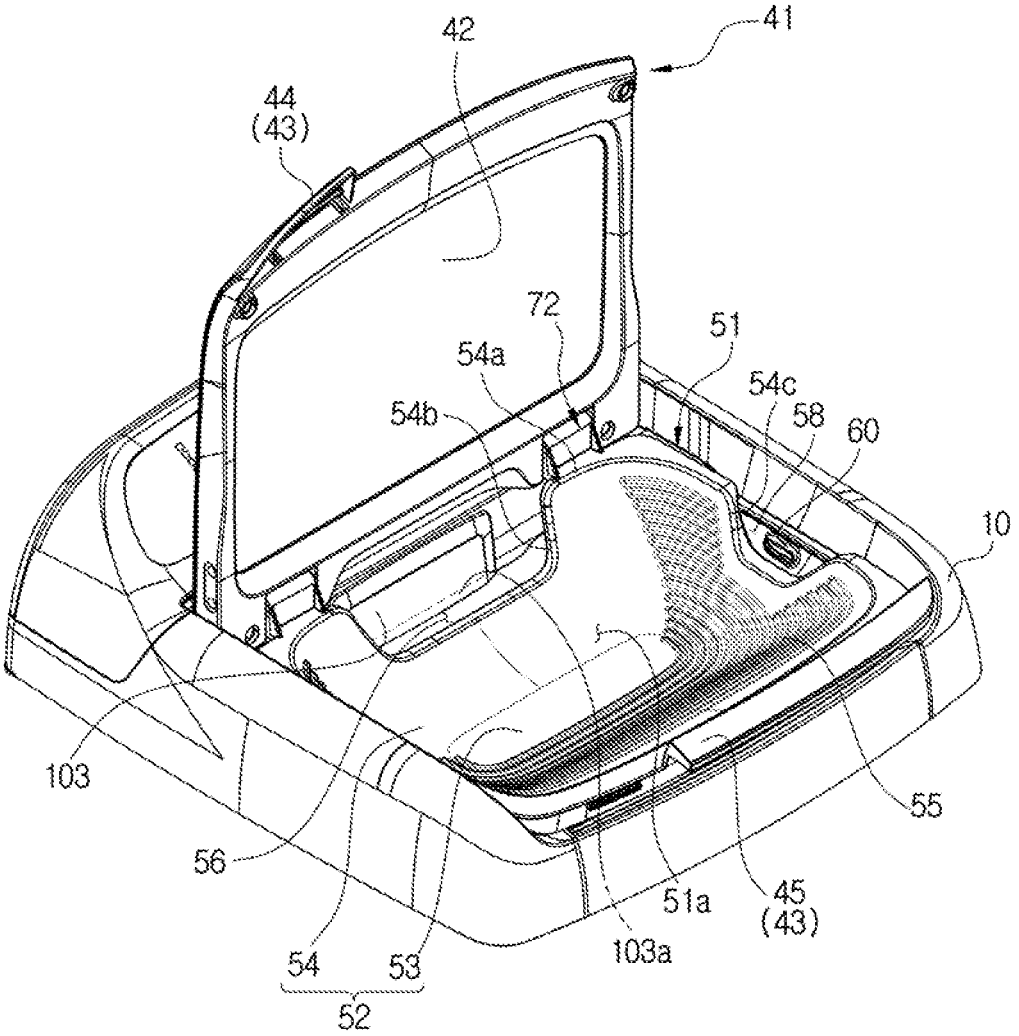
FIG. 2 is a perspective view showing a state in which a door of the washing machine shown in FIG. 1 is opened.
Figure 3:
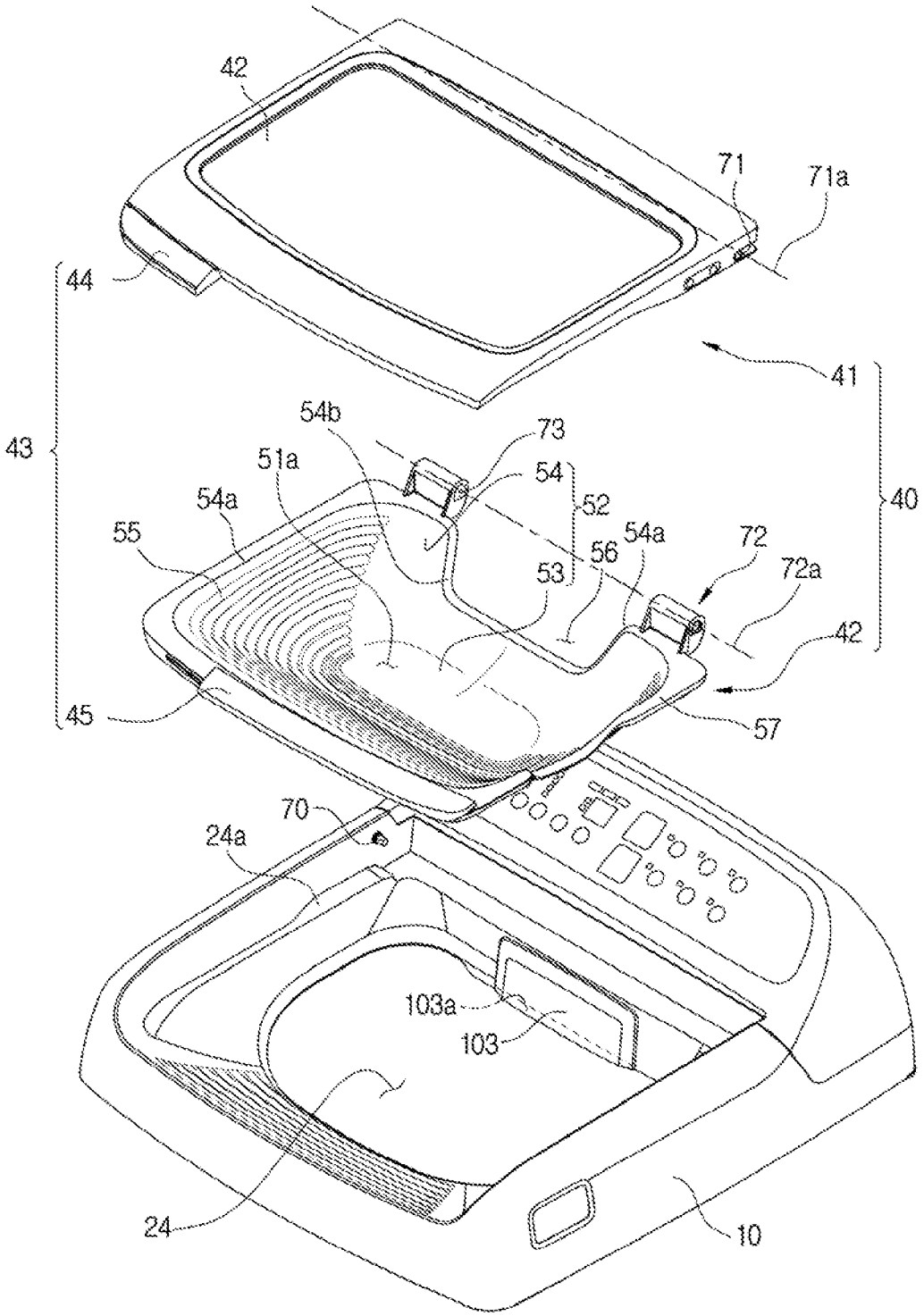
FIG. 3 is an exploded perspective view showing a door assembly of the washing machine shown in FIG. 1.
Figure 4:
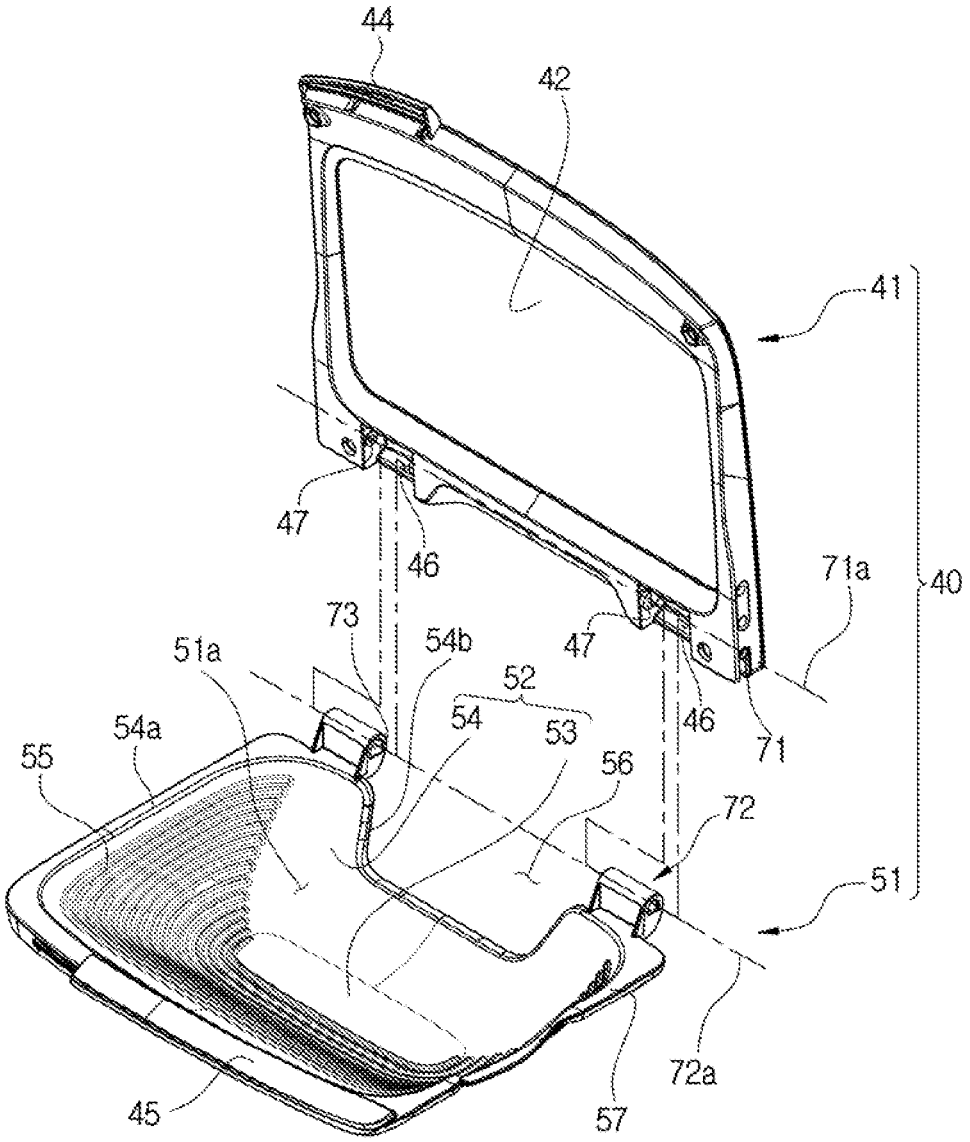
FIG. 4 is a perspective view showing a coupling state between the door and an auxiliary washing unit of the washing machine shown in FIG. 1.

FIG. 1 is a cross-sectional view showing a washing machine 1 according to an embodiment of the present invention, FIG. 2 is a perspective view showing a state in which a door 41 of the washing machine 1 shown in FIG. 1 is opened, FIG. 3 is an exploded perspective view showing a door assembly 40 of the washing machine 1 shown in FIG. 1, and FIG. 4 is a perspective view showing a coupling state between the door 41 and an auxiliary washing unit 51 of the washing machine 1 shown in FIG. 1.

As shown in FIG. 1, the washing machine 1 includes a cabinet 10 that forms an exterior thereof, a tub 11 that is disposed inside the cabinet 10 to store washing water, a rotating tub 12 that is rotatably disposed inside the tub 11, and a pulsator 50 that is disposed inside the rotating tub 12 and generates a water flow.

An opening 24 is formed in an upper portion of the cabinet 10 so that laundry may be put into the rotating tub 12. The opening 24 may be opened and closed by the door assembly 40 installed in the upper portion of the cabinet 10. The tub 11 may be supported in the cabinet 10 by a suspension device 15.

A main water supply pipe 102*a* for supplying washing water to the tub 11 is installed in an upper portion of the tub 11. One side of the main water supply pipe 102*a* is connected to an external water supply source (not shown) and the other side thereof is connected to a detergent supply device 103. Water supplied through the main water supply pipe 102*a* passes through the detergent supply device 103 and is supplied into the tub 11 through a detergent supply hole 103*a* together with a detergent. A water supply valve 18 is installed in the main water supply pipe 102*a* to control the supply of water.

The rotating tub 12 is formed in a cylindrical shape whose upper portion is opened, and a plurality of dehydration holes 13 are formed on a side surface of the rotating tub 12. A balancer 14 may be mounted on the upper portion of the rotating tub 12 so that the rotating tub 12 may be stably rotated when rotated at a high speed.

In a lower outside of the tub 11, a motor 25 that generates a driving force to rotate the rotating tub 12 and the pulsator 50 and a power switching device 26 that simultaneously or selectively transmits the driving force generated by the motor 25 to the rotating tub 12 and the pulsator 50 are installed.

A hollow dehydration shaft 29 may be coupled to the rotating tub 12, and a washing shaft 27 installed in a hollow portion of the dehydration shaft 29 may be coupled to the pulsator 50 through a washing shaft coupling unit 28. The motor 25 may simultaneously or selectively transmit the driving force to the rotating tub 12 and the pulsator 50 in response to an elevation operation of the power switching device 26.

The power switching device 26 may include an actuator 30 that generates a driving force for power switching, a rod 31 that moves linearly in accordance with an operation of the actuator 30, and a clutch 32 that is connected to the rod 31 and is rotated in accordance with an operation of the rod 31.

A drainage port 20 through which the washing water stored in the tub 12 is discharged is formed at the bottom of the tub 12, and a first drainage pipe 21 is connected to the drainage port 20. A drainage valve 22 that regulates drainage may be installed in the first drainage pipe 21. An outlet of the drainage valve 22 may be connected to a second drainage pipe 34 for discharging washing water to the outside.

The door assembly 40 is provided in the opening 24.

The door assembly 40 may include the door 41 and the auxiliary washing unit 51.

The door 41 is provided at one side of the cabinet 10 to open and close the opening 24. The door 41 may include a transparent member 42 through which the inside of the washing machine may be viewed even when the opening 24 is closed.

The auxiliary washing unit 51 may include an auxiliary washing space 51*a* to perform separate hand-washing. The auxiliary washing space 51*a* is separated from a main washing space 11*a* formed by the tub and the rotating tub so that washing may be performed in the auxiliary washing space 51*a*. The main washing space 11*a* may be provided to be separated from the auxiliary washing space 51*a*. The tub and the rotating tub that form the main washing space 11*a* may be defined as a laundry tub.

The main washing space 11*a* and the auxiliary washing space 51*a* are separated from each other so that washing may be independently performed in each of the spaces. In addition, washing in the main washing space 11*a* and the auxiliary washing space 51*a* may be separately or simultaneously performed.

The auxiliary washing unit 51 may be provided to be rotatable with respect to one side of the door 41 inside the door 41. The auxiliary washing unit 51 may be provided to have the same axis as the door 41 to match a rotary axis of the door 41.

The auxiliary washing unit 51 may include a unit body 52 constituted of a bottom portion 53 and a side surface portion 54.

The auxiliary washing space 51*a* of the auxiliary washing unit 51 is formed by the unit body 52. The bottom portion 53 is a factor that determines a depth of the auxiliary washing space 51*a*, and may be provided to be flat or formed to have a curved surface. The side surface portion 54 may be formed to be inclined toward the bottom portion 53.

The bottom portion 53 and the side surface portion 54 may be provided to have the substantially concave auxiliary washing space 51*a* so that washing water may be received in the auxiliary washing space 51*a* and separate washing may be performed therein.

The auxiliary washing unit 51 may include a frictional protrusion 55.

The frictional protrusion 55 is provided in the unit body 52 to facilitate auxiliary washing. In the embodiment of the present invention, the frictional protrusion 55 is provided on the side surface portion 54, but is not limited thereto. There is no limitation in the position of the frictional protrusion 55 as long as it is provided on an inner surface of the unit body 52. The frictional protrusion 55 may serve to increase a frictional force with laundry during hand-washing to effectively remove stains of the laundry. In the embodiment of the present invention, the frictional protrusion 55 is formed to be more convex than an adjacent inner surface of the auxiliary washing unit 51 on the inner surface of the auxiliary washing unit 51. According to the embodiment of the present invention, a plurality of frictional protrusions 55 may be provided side by side, but a shape and arrangement of the frictional protrusion 55 are not limited.

The auxiliary washing unit 51 may include an auxiliary drainage port 56.

The auxiliary drainage port 56 may be provided so that washing water used in the auxiliary washing space 51*a* may be drained therethrough. The auxiliary drainage port 56 may be provided in the form of a hole, and may be disposed at the bottom portion 53 of the auxiliary washing space 51*a* while having a separate opening/closing member. In the embodiment of the present invention, the auxiliary drainage port 56 may be provided on the side surface portion 54 of the unit body 52.

The auxiliary drainage port 56 is provided so that washing water stored in the auxiliary washing space 51*a* may be obliquely discharged when the auxiliary washing unit 51 is rotated.

The auxiliary drainage port 56 may be formed by forming a periphery 54*b* of the auxiliary drainage port 56 to be lower than an upper end portion 54*a* of the adjacent unit body 52 in the unit body 52. That is, the auxiliary drainage port 56 may be formed in a portion that is recessed with respect to the upper end portion of the unit body 52. However, a shape of the auxiliary drainage port 56 is not limited, and there is no limitation in the shape of the auxiliary drainage port 56 as long as the washing water stored in the auxiliary washing space 51*a* can be discharged when the auxiliary washing unit 51 is inclined.

The auxiliary washing unit 51 may include a seating flange 57.

The seating flange 57 is formed to have a flange shape along a periphery of an upper end of the auxiliary washing unit 51, and seated on the cabinet 10. That is, the seating flange 57 may be formed in a flange shape along the upper end of the unit body 52.

A seated portion 24*a* that protrudes along a periphery of the opening 24 may be provided on an inner surface of the opening 24 side of the cabinet 10. The seating flange 57 may be provided to be seated on the seated portion 24*a*. Since the seating flange 57 is seated on the seated portion 24*a*, the auxiliary washing unit 51 may be fixed to the cabinet 10.

The auxiliary washing unit 51 may be made of a thermoplastic resin. The auxiliary washing unit 51 may be provided with an ABS material. However, the present invention is not limited thereto, and there is no limitation in a material of the auxiliary washing unit 51 as long as the material has impact resistance, rigidity, and the like which are required for hand-washing.

Each of the door 41 and the auxiliary washing unit 51 is provided to be rotatable with respect to the cabinet 10.

The door 41 is provided to be rotatable around a door rotary shaft 71*a*, and the auxiliary washing unit 51 is provided to be rotatable around an auxiliary rotary shaft 72*a*.

The door rotary shaft 71*a* and the auxiliary rotary shaft 72*a* may be provided on the same axis. That is, the door rotary shaft 71*a* and the auxiliary rotary shaft 72*a* may be provided to coincide with each other.

To this end, the door 41 may be rotatably coupled to the cabinet 10 by a door rotary portion 70 provided in the cabinet 10 along the door rotary shaft 71*a*, and the auxiliary washing unit 51 may be rotatably coupled to the door 41 by an auxiliary rotary portion 72.

The door rotary portion 70 may protrude in a direction of the door rotary shaft 71*a* so that the door 41 may be rotated around the door rotary shaft 71*a* in the cabinet 10. Specifically, a receiving portion 71 is provided in the door 41, and when the door rotary portion 70 is inserted into the receiving portion 71, the door 41 may be rotatably supported on the cabinet 10. However, the present invention is not limited thereto, and the door rotary portion 70 may protrude in a projection shape in the direction of the door rotary shaft 71*a* so that the door 41 may be rotated around the door rotary shaft 71*a* on an outer surface of the door 41. There is no limitation in the shape of the door rotary portion 70 as long as the door 41 is provided to be rotatable with respect to the cabinet 10.

The door 41 includes an insertion portion 46 that is concavely formed at one side of the door 41 so that the auxiliary rotary portion 72 may be rotated, and a rotary protrusion 47 that protrudes in a direction of the auxiliary rotary shaft 72*a* may be formed in the insertion unit 46 so that the auxiliary washing unit 51 may be rotated around the auxiliary rotary shaft 72*a*. A rotary hole 73 may be formed in the auxiliary washing unit 51 to correspond to the rotary protrusion 47. The auxiliary rotary portion 72 may be inserted into a part of the door 41 and rotated so that the door rotary shaft 71*a* and the auxiliary rotary shaft 72*a* coincide with each other.

However, the rotation and arrangement of the door 41 and the auxiliary washing unit 51 are not limited thereto, and there is no limitation in the rotation and arrangement as long as the door 41 and the auxiliary washing unit 51 are provided to open and close the opening 24.

The auxiliary rotary portion 72 is provided to protrude from the unit body 52 so that the auxiliary rotary shaft 72*a* is spaced apart from the unit body 52. In this structure, a radius of rotation of the auxiliary washing unit 51 may be increased, and the door 41 or the cabinet 10 may be prevented from interfering with the unit body 52 when the auxiliary washing unit 51 is rotated.

The door assembly 41 may include a handle 43.

The handle 43 may include a door handle 44 provided in the door 41 and an auxiliary handle 45 provided in the auxiliary washing unit 51.

The door handle 44 may be provided at the other side of the door 41 to correspond to the door rotary shaft 71*a* provided at one side of the door handle 44.

In the same manner, as the auxiliary rotary shaft 72*a* is provided at one side of the auxiliary handle 45, the auxiliary handle 45 may be provided at the other side of the auxiliary washing unit 51 to correspond thereto. The door handle 44 and the auxiliary handle 45 may be provided side by side in a longitudinal direction.

The door handle 44 and the auxiliary handle 45 may be respectively provided on a front surface of the door 41 and a front surface of the auxiliary washing unit 41 to respectively rotate the door 41 and the auxiliary washing unit 51. The door 41 may be rotated by operating the door handle 44, and the auxiliary washing unit 51 and the door 41 may be rotated together of only the auxiliary washing unit 51 may be rotated by operating the auxiliary handle 45.

The door handle 44 may be formed with a first length L1 with respect to a front surface of the door assembly 40, and the auxiliary handle 45 may be formed with a second length L2 side by side with the first length L1. The door 41 may be rotated when the door handle 44 is operated, and the auxiliary washing unit 51 may be rotated when the auxiliary handle 45 is operated while the door 41 is opened.

The door 41 and the auxiliary washing unit 51 may be rotated together when the auxiliary handle 45 is operated while the door 41 is closed, and therefore the second length L2 may be formed to be longer than the first length L1 in consideration of a weight of each of the door 41 and the auxiliary washing unit 51. That is, the auxiliary handle 45 may be formed to be longer than the door handle 44.

Figure 5:
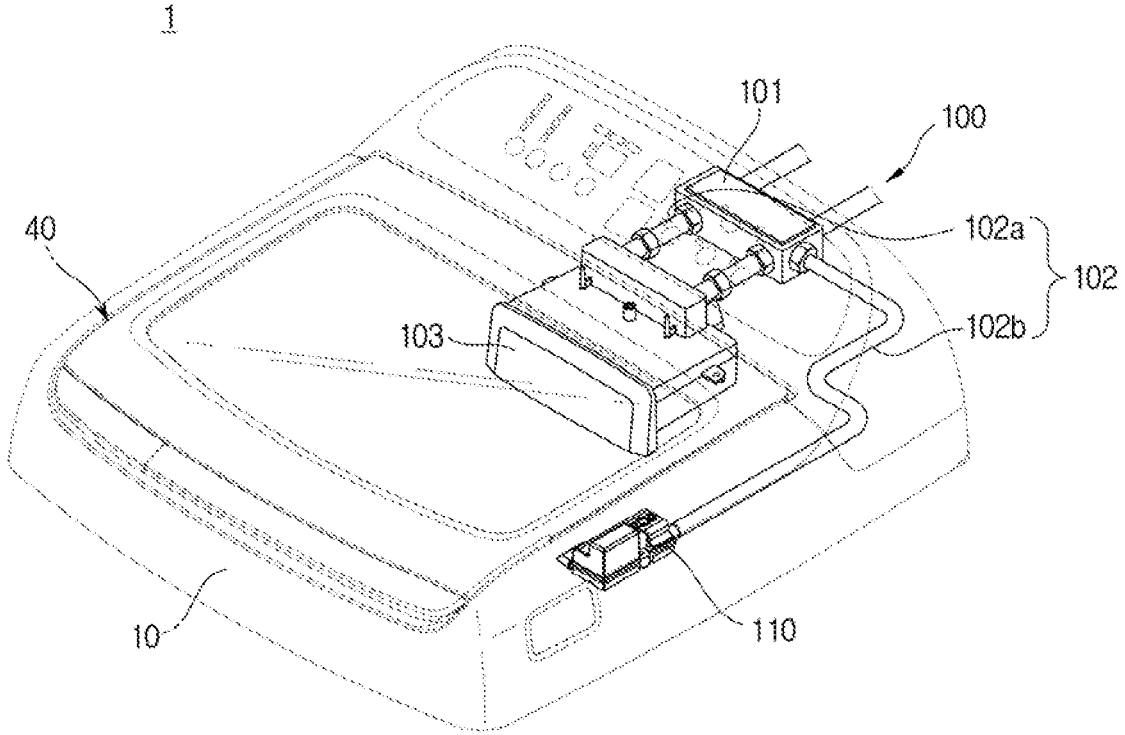
FIG. 5 is a perspective view showing a water supply unit shown in FIG. 1.

FIG. 5 is a perspective view showing a water supply unit 100 shown in FIG. 1.

The washing machine 1 may include the water supply unit 100 for supplying water to the main washing space 11*a* and the auxiliary washing space 51*a*.

The water supply unit 100 may include a water supply valve 101, the water supply pipe 102, the detergent supply device 103, and a water supply device 110. The water supply pipe 102 may include the main water supply pipe 102*a* and an auxiliary water supply pipe 102*b*.

The water supply valve 101 is provided in the cabinet 10 so that washing water may be supplied from an external water supply source of the cabinet 10 to the inside of the cabinet 10.

The water supply valve 101 may control a supply of water to the detergent supply device 103 and a supply of water to the water supply device 110. The supply of water to the detergent supply device 103 and the supply of water to the water supply device 110 may be independently controlled so that control of the supply of water to the main washing space 11*a* and to the auxiliary washing space 51*a* may be separately performed. The supply of water to the water supply device 110 may be controlled through a separate control button (not shown). In addition, a user may control the supply of water to the water supply device 110 by pushing a control pedal (not shown) installed in a lower portion of the cabinet 10. However, these examples are not limiting, and the supply of water to the water supply device 110 may be controlled through a variety of structures and methods.

The water supply valve 101 is connected to the detergent supply device 103 and the water supply device 110 through the main water supply pipe 102*a* and the auxiliary water supply pipe 102*b*, respectively. The water supply device 110 will be described in detail later.

A washing water inflow port 58 is provided in the auxiliary washing unit 51 to correspond to an auxiliary water supply port 60 so that washing water guided through the water supply valve 101 and the auxiliary water supply pipe 102*b* may be supplied to the auxiliary washing unit 51 via the water supply device 110. The washing water inflow port 58 may be formed by forming an inflow port periphery 54*c* to be lower than the upper end portion 54*a* of the adjacent unit body 52 in the unit body 52. That is, the washing water inflow port 58 may be formed in a portion that is concavely formed with respect to the upper end portion of the unit body 52. However, there is no limitation in the shape of the washing water inflow port 58 as long as washing water can flow into the auxiliary washing space 51*a* without being interfered with by the unit body 52 when the washing water is introduced through the water supply device 110.

The water supply device 110 is provided to supply washing water to the auxiliary washing space 51*a*. The water supply device 110 is provided to supply washing water to the auxiliary washing space 51*a* through the washing water inflow port 58 that is concavely formed on the auxiliary washing unit 51.

The water supply device 110 is provided in a side portion of the auxiliary washing unit 51 to supply washing water to the side portion of the auxiliary washing unit 51. However, the present invention is not limited thereto, and the water supply device 110 may be disposed to supply washing water in a different direction with respect to the auxiliary washing unit 51 as will be described in the following embodiment.

Figure 6:
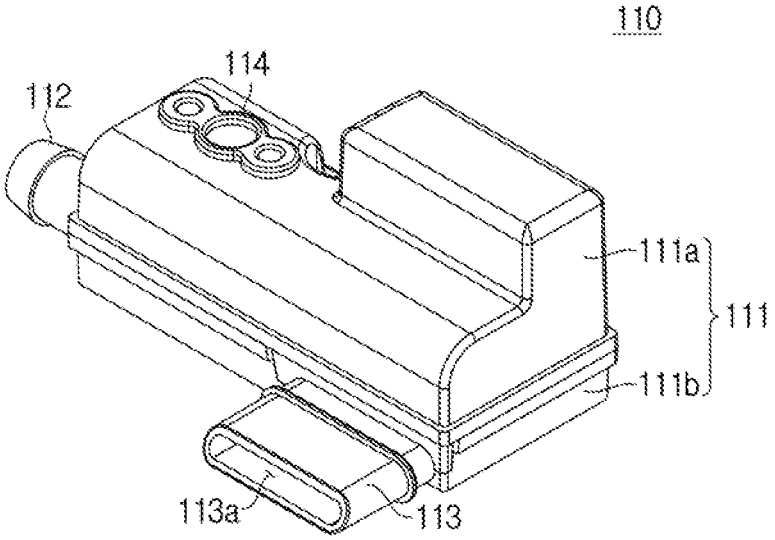
FIG. 6 is a perspective view showing the water supply device shown in FIG. 5.
Figure 7:
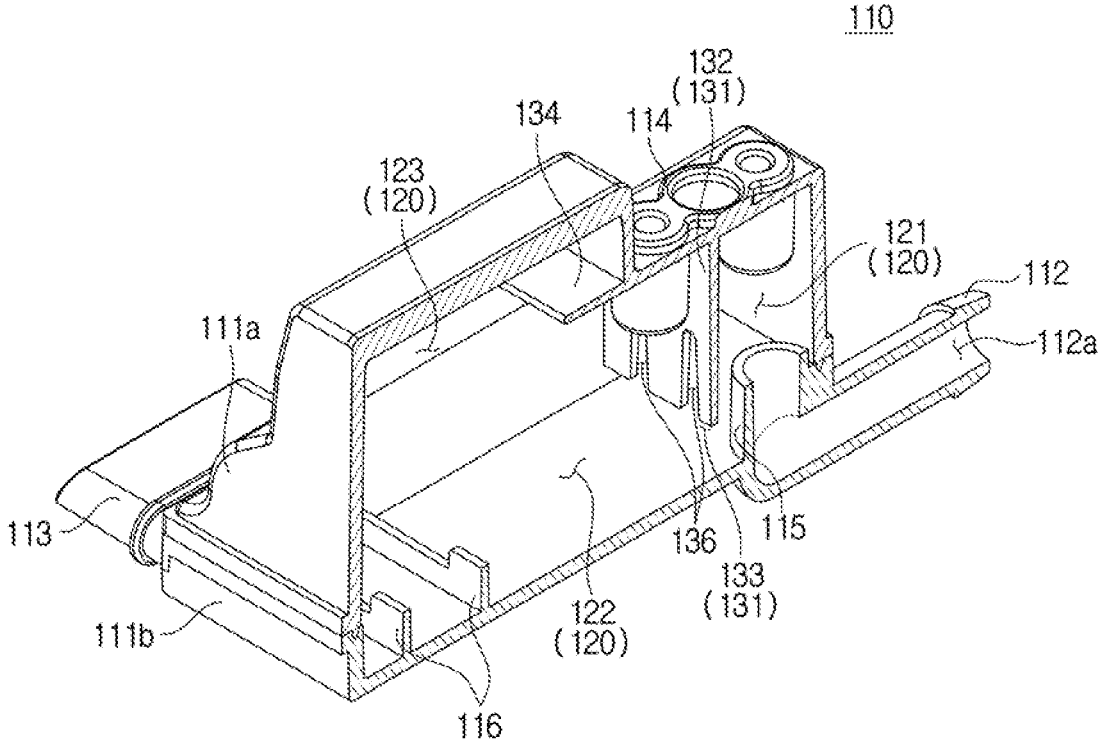
FIG. 7 is a cross-sectional view showing the water supply device shown in FIG. 6.
Figure 8:
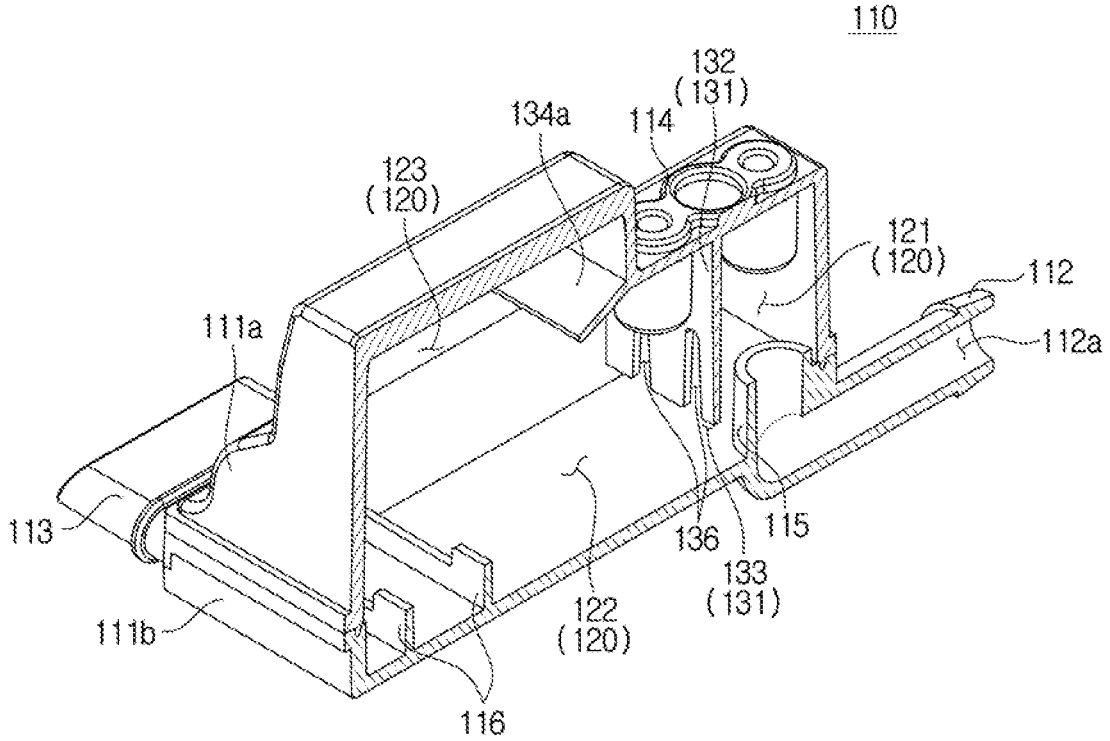
FIG. 8 is a view showing a different embodiment of a blocking rib shown in FIG. 7.
Figure 9:
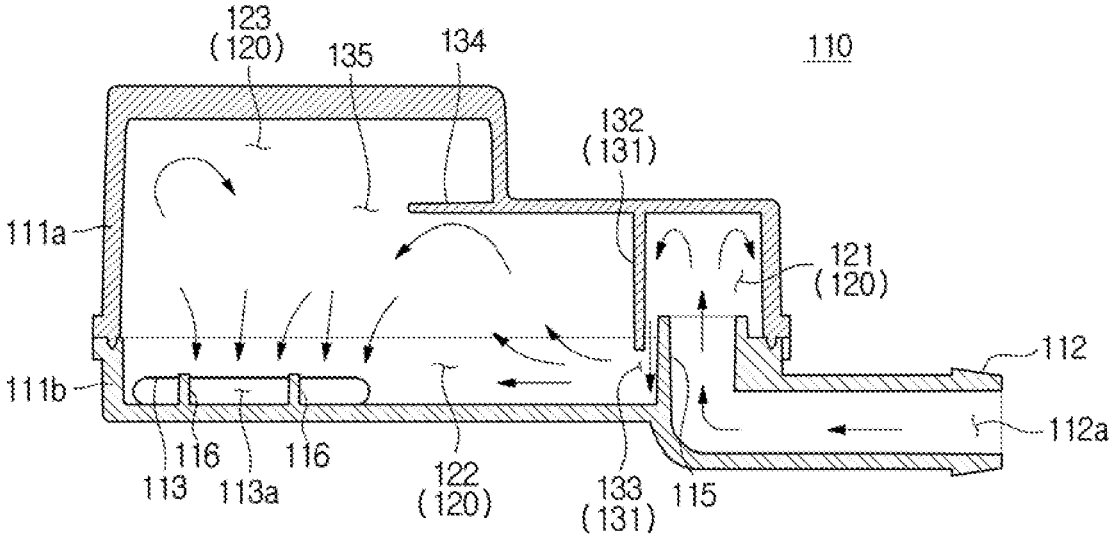
FIG. 9 is a cross-sectional view showing a flow of water inside the water supply device shown in FIG. 5.

FIG. 6 is a perspective view showing the water supply device 110 shown in FIG. 5, FIG. 7 is a cross-sectional view showing the water supply device 110 shown in FIG. 6, FIG. 8 is a view showing a different embodiment of a blocking rib 134 shown in FIG. 7, and FIG. 9 is a cross-sectional view showing a flow of water inside the water supply device 110 shown in FIG. 5.

The water supply device 110 may include a housing 111, and an inflow pipe 112 and an outflow pipe 113 provided in the housing 111.

The housing 111 may form an exterior of the water supply device 110, and may be provided in a form in which an upper one side of an approximately cube shape protrudes, but the present invention is not limited thereto. The housing 111 includes an upper housing 111*a* and a lower housing 111*b*, and an inner space 120 may be formed by the upper housing 111*a* and the lower housing 111*b* being coupled.

The housing 111 may include a thermistor coupling hole 114 in which a thermistor (not shown) for stopping the supply of water is disposed when washing water of a preset temperature or higher is supplied by measuring a temperature of the supplied washing water. The thermistor coupling hole 114 may be provided on an outer surface of the housing 111 in which an inflow chamber 121 communicating with the inflow pipe 112 is formed in order to determine whether the supply of water is stopped by measuring the temperature of the supplied washing water. Accordingly, the water supply device 110 may automatically stop the supply of water when washing water of a temperature high enough to cause discomfort to a user is supplied.

The inflow pipe 112 is connected to the water supply valve 101 to guide the washing water supplied from the water supply valve 101 to the inside of the housing 111. The inflow pipe 112 includes an inlet 112*a* into which washing water flows so that the washing water is introduced to the inside of the housing 111.

The outflow pipe 113 communicates with the inside of the housing 111 and is provided to discharge washing water to the auxiliary washing unit 51. The outflow pipe 113 is provided in a direction perpendicular to the inflow pipe 112 so washing water is supplied to a side surface of the auxiliary washing unit 51, but the outflow pipe 113 may be disposed in the same direction as the inflow pipe 112 according to an embodiment which will be described later, or unlike the embodiment shown in FIG. 6, the outflow pipe 113 may be disposed in a different direction. The outflow pipe 113 includes an outlet 113*a* formed therein which discharges washing water and which communicates with the outside.

The outflow pipe 113 may include an outflow guide rib 116 that extends along a discharge direction of water discharged from a discharge chamber 122 and guides the water discharged from the discharge chamber 122 to be uniformly discharged. The water discharged from the outflow pipe 113 by the outflow guide rib 116 may be uniformly discharged in left and right directions. The outflow guide rib 116 may extend a preset length along a bottom surface of the housing 111 from the outflow pipe 113. Accordingly, water stored inside the discharge chamber 122 may be guided from the discharge chamber 122 and uniformly discharged from the outflow pipe 113.

The housing 111 includes the inner space 120 which temporarily stores washing water that is introduced therein before the washing water is discharged. The inner space 120 may include the inflow chamber 121 that communicates with the inflow pipe 112 and adjusts water pressure of the introduced washing water, the discharge chamber 122 that communicates with the inflow chamber 121 and the outflow pipe 113, and a buffer chamber 123 that communicates with the discharge chamber 122 and forms an air pocket.

The washing water introduced from the inflow pipe 112 is temporarily stored in the inflow chamber 121. The inflow chamber 121 is configured so that water pressure of the washing water introduced from the inflow pipe 112 may be reduced. The inflow chamber 121 may be disposed to be spaced apart from the outflow pipe 113 and provided to communicate with the inflow pipe 112.

The inflow chamber 121 may be formed to have a wider width than a width of the inflow pipe 112 or a width of a flow passage through which washing water passes inside an extension pipe 115 which will be described later. Through this, since the inflow chamber 121 may have a wide cross-sectional area for regularizing flow rate, flow velocity and water pressure of the washing water may be reduced.

The extension pipe 115 that extends from the inflow pipe 112 may be provided inside the inflow chamber 121. The extension pipe 115 may be formed to be bent from the inflow pipe 121, and more specifically, formed to be bent upward inside the inflow chamber 121.

Since a discharge port of the extension pipe 115 protrudes upward inside the inflow chamber 121, pressure of the washing water flowing through the inflow pipe 112 and the extension pipe 115 may be reduced while the washing water collides with an inner surface of the upper portion of the housing 111.

The discharge chamber 122 is provided so that the washing water introduced from the inflow chamber 121 is temporarily stored therein before being discharged through the outflow pipe 113.

The buffer chamber 123 is provided in an upper portion of the inner space 120 according to the direction of gravity in the discharge chamber 122. The buffer chamber 123 may have a substantially hexahedral shape. The buffer chamber 123 forms an air pocket when the supply of water to the water supply device 110 is stopped.

A water pressure adjuster 131 may be provided between the inflow chamber 121 and the discharge chamber 122. The water pressure adjuster 131 may partition the inflow chamber 121 from the discharge chamber 122. In addition, the water pressure adjuster 131 may adjust the water pressure and flow rate of the washing water flowing from the inflow chamber 121 to the discharge chamber 122 by throttling the washing water. The water pressure adjuster 131 may include a water pressure adjusting rib 132 and a water pressure adjusting hole 133.

The water pressure adjusting rib 132 may be provided at one side of the inflow chamber 121. The water pressure adjusting rib 132 may be disposed between the inflow chamber 121 and the discharge chamber 122 to partition the inflow chamber 121 from the discharge chamber 122.

The water pressure adjusting rib 132 may extend from an inner surface of the housing 111 and may be provided inside the housing 111 so as to intercept at least a part of the washing water moving from the inflow chamber 121 to the discharge chamber 122. Through this configuration, the washing water moving from the inflow chamber 121 to the discharge chamber 122 may be moved only through the water pressure adjusting hole 133 which will be described later. The water pressure adjusting rib 132 is provided to be perpendicular to an advancing direction of the washing water, but is not limited thereto.

In addition, the water pressure adjusting rib 132 may include an air pocket hole 136 that is formed to pass therethrough so that a part of an air pocket generated in the buffer chamber 123 is moved to the inflow chamber 121. The air pocket hole 136 may enable the inflow chamber 121 and the discharge chamber 122 to communicate with each other. In FIG. 7, two slit-shaped air pocket holes 136 are shown, but the number and shape of the air pocket holes 136 are not limited thereto. More specifically, there is no limitation in the number and shape of the air pocket holes 136 as long as an air pocket formed in the buffer chamber 123 can be moved to the inflow chamber 121 when the supply of water is stopped. For example, the air pocket hole 136 may be provided with a plurality of through-holes or provided in a long hole (a slot) shape.

The water pressure adjuster 131 may include the water pressure adjusting hole 133 that enables the inflow chamber 121 and the discharge chamber 122 to communicate with each other so that the washing water may be moved from the inflow chamber 121 to the discharge chamber 122. The water pressure adjusting hole 133 may be formed on the same plane as the water pressure adjusting rib 132.

Specifically, the water pressure adjusting rib 131 may extend from an upper surface of the inner surface of the housing 111 to a bottom surface thereof, and in this instance, a lower end portion of the water pressure adjusting rib 131 is provided to be spaced apart from the inner surface of the housing 111, thereby forming the water pressure adjusting hole 132 that throttles the washing water flowing from the inflow chamber 121 to the discharge chamber 122. The water pressure adjusting hole 132 may adjust the water pressure and flow rate of the washing water by throttling the washing water flowing from the inflow chamber 121 to the discharge chamber 122.

In addition, the water pressure adjusting hole 133 may be disposed in a lower portion of the inflow chamber 122. The discharge port of the extension pipe 115 is provided inside the inflow chamber 121 to face upward, and the water pressure adjusting hole 133 may be disposed in a lower portion of the inflow chamber 121 so that the washing water discharged to the discharge port of the extension pipe 115 may be bypassed inside the inflow chamber 121 and be discharged to the water pressure adjusting hole 133 without being discharged directly through the water pressure adjusting hole 133. However, the disposition of the water pressure adjusting hole 133 is not limited thereto, and there is no limitation in the disposition of the water pressure adjusting hole 133 as long as the water pressure adjusting hole 133 is disposed on the same plane as the water pressure adjusting rib 132.

The water pressure adjusting rib 132 and the water pressure adjusting hole 133 may act as a throttling device that performs a throttling action between the inflow chamber 121 and the discharge chamber 122. That is, the water pressure adjusting hole 133 is formed to have a narrower width than an inner width of the housing 111 in the advancing direction of the washing water so that the pressure of the washing water may be lowered by friction. The pressure and flow rate of the washing water may be adjusted through the throttling action in the water pressure adjusting hole 133.

However, the width of the water pressure adjusting hole 133 is not limited thereto, and it is satisfactory for the width of the water pressure adjusting hole 133 to be narrower than a width of the cross-section of each of the inflow chamber 121 and the discharge chamber 122. In the embodiments shown in FIGS. 6 to 9, the inflow chamber 121, the water pressure adjusting hole 133, and the discharge chamber 122 are provided to have the same width, and the water pressure adjusting hole 133 has a height of 2 to 3 mm, but the embodiment is not limited thereto.

The blocking rib 134 may be provided between the discharge chamber 122 and the buffer chamber 123. The blocking rib 134 is provided to extend from the inner surface of the housing 111 and partition the discharge chamber 122 from the buffer chamber 123. The blocking rib 134 may extend from an inner surface of the housing 111 adjacent to the inflow chamber 121. The blocking rib 134 may be provided on a boundary of the discharge chamber 122 and the buffer chamber 123.

The blocking rib 134 may be provided at a position corresponding to a height of water stored inside the water supply device 110 when the water supply device 110 supplies water to the auxiliary washing unit 51. The blocking rib 134 may be provided at a position corresponding to approximately ⅔ of a height of the housing 111.

The blocking rib 134 may be provided at a portion at which breaking waves are generated according to a flow of water introduced from the water pressure adjusting hole 133 into the discharge chamber 122. The water introduced from the inflow chamber 121 into the discharge chamber 122 through the water pressure adjusting hole 133 generates breaking waves at a boundary layer with air. Such breaking waves may advance toward the outflow pipe 113 while surrounding a part of air existing in the buffer chamber 123, and may be discharged to the auxiliary washing unit 51 together with the air. According to this phenomenon, the height of the water stored inside the water supply device 110 may be gradually increased as the supply of water proceeds. A size of the air pocket formed inside the water supply device 110 when the supply of water is stopped is reduced along with an increase in the height of the water stored inside the water supply device 110, and when the size of the air pocket is reduced so that a volume of frozen water is expanded and residual water existing inside the water supply device 110 is frozen, a buffer space which may receive the expanded volume is lacking and there is a problem of freeze-breakage of the water supply device 110.

Since the blocking rib 134 is provided at a portion at which the water introduced into the discharge chamber 122 through the water pressure adjusting hole 133 generates breaking waves, generation of the breaking waves may be prevented. Accordingly, it is possible to prevent the height of the water stored inside the water supply device 110 from being increased even when the water supply device 110 is continuously used.

Referring to FIG. 7, the blocking rib 134 may be provided in a direction substantially perpendicular to the direction of gravity. That is, the blocking rib 134 may extend in a direction substantially horizontal to the bottom surface of the housing 111. On the other hand, referring to FIG. 8, the blocking rib 134*a* may be provided to be inclined downward from the inner surface of the housing 111 toward the bottom surface thereof. Accordingly, the blocking rib 134*a* shown in FIG. 8 may set the height of the residual water stored inside the housing 111 to be lower than that of the embodiment shown in FIG. 7.

At least one end portion of the blocking rib 134 may be spaced apart from the inner surface of the housing 111 to form a buffer hole 135 that enables the discharge chamber 122 and the buffer chamber 123 to communicate with each other. In a case in which the water supply device 110 stops the supply of water, since the buffer hole 135 may accommodate residual water having the same volume as an expanded volume of the buffer chamber 123 even when the residual water remaining inside the water supply device 110 is frozen and increases in volume in winter, freeze-breakage of the water supply device 110 may be prevented.

The flow of washing water inside the water supply device 110 shown in FIG. 6 will be described with reference to FIG. 9.

When the auxiliary water supply pipe 102*b* is opened through an operation of the water supply valve 101, washing water may be guided to the water supply device 110. The washing water introduced through the auxiliary water supply pipe 102*b* may be introduced to the inside of the inflow chamber 121 via the inflow pipe 112 and the extension pipe 115. At this point, the width of the inflow chamber 121 is wider than a width of a flow passage through which washing water flows inside the inflow pipe 112 and the extension pipe 115 so that a flow velocity and water pressure of the washing water is reduced while the washing water is discharged from the inflow pipe 112 and the extension pipe 115 into the inflow chamber 121. In addition, the extension pipe 115 is bent upward inside the inflow chamber 112 so that the washing water is moved upward and the water pressure of the washing water is reduced.

The washing water introduced into the inflow chamber 112 is temporarily stored inside the inflow chamber 112, and is then discharged through the water pressure adjusting hole 133 to the discharge chamber 122.

At this point, the water pressure adjusting rib 132 is provided between the inflow chamber 112 and the discharge chamber 122, so that the washing water moving from the inflow chamber 112 to the discharge chamber 122 may be throttled to reduce the water pressure of the washing water.

The washing water introduced into the discharge chamber 122 is temporarily stored inside the discharge chamber 122 while colliding with another side opposite to one side of the discharge chamber 122 in which the water pressure adjusting hole 133 is provided. At this point, in the water supply device 110 according to an embodiment of the present invention, the blocking rib 134 is provided at a substantial boundary portion between the buffer chamber 123 and the discharge chamber 122 to prevent breaking waves from being generated according to a flow of the washing water. Accordingly, it is possible to prevent breaking waves generated by the washing water from being discharged through the outflow pipe 113 together with air inside the buffer chamber 123, and therefore it is possible to prevent an increase in a water level of residual water existing inside the housing 111 even though the water supply device 110 is continuously used.

The washing water discharged from the discharge chamber 122 may be guided by the inflow pipe 113 and the outflow guide rib 116 provided at a lower surface of the discharge chamber 122 and uniformly discharged through the outlet 113*a* of the inflow pipe 113.

Next, when the supply of water is stopped, an air pocket is formed in the buffer chamber 123, and residual water exists in the discharge chamber 122. The residual water existing in the discharge chamber 122 fails to be discharged to the outside by surface tension on the outflow pipe 113. In addition, at a moment when the supply of water is stopped, a part of the air pocket formed in the buffer chamber 123 passes through the air pocket hole 136 by inertia and is moved to the inflow chamber 121. Accordingly, an air pocket may even be formed in the inflow chamber 121.

By the water supply device 110 having the above-described structure, the washing machine 1 according to an embodiment of the present invention may stably supply washing water to the auxiliary washing unit 51 and prevent freeze-breakage of the water supply device 110 due to an increase in the volume of the washing water even when residual water existing inside the water supply device 110 is frozen in winter. In addition, it is possible to retain a certain amount of residual water inside the water supply device 110.

An example in which the water supply device 110 according to an embodiment of the present invention is applied to the washing machine 1 has been described above, but the present invention is not limited thereto. The water supply device 110 is certainly applicable to any device that needs water supply.

Figure 10:
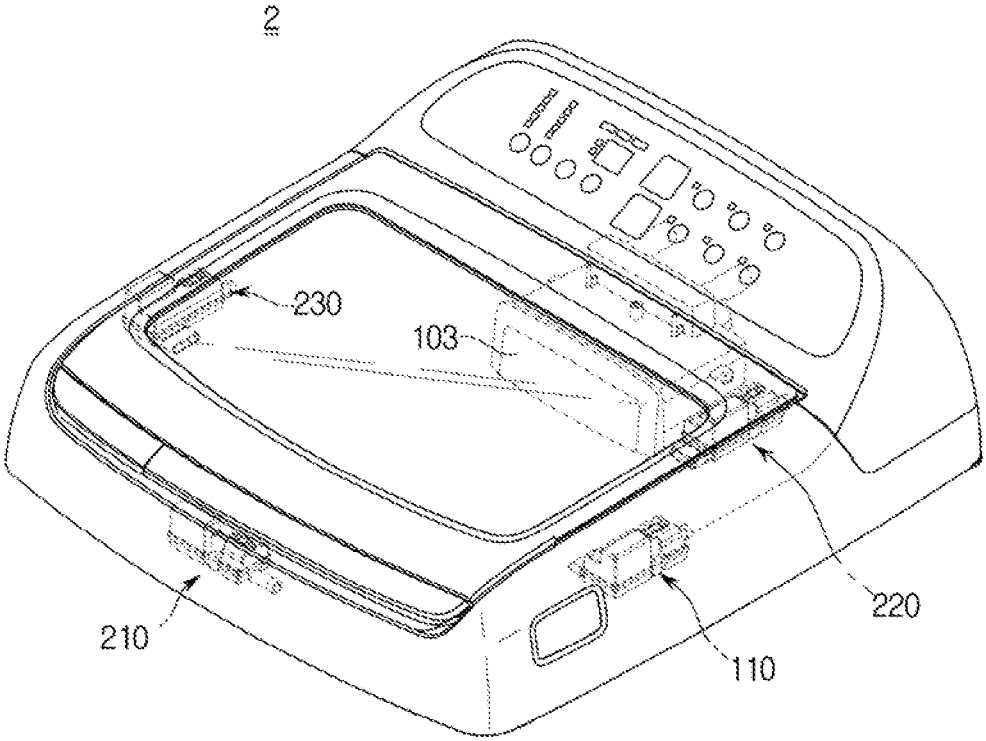
FIG. 10 is a view showing another embodiment of the water supply unit shown in FIG. 1.
Figure 11:
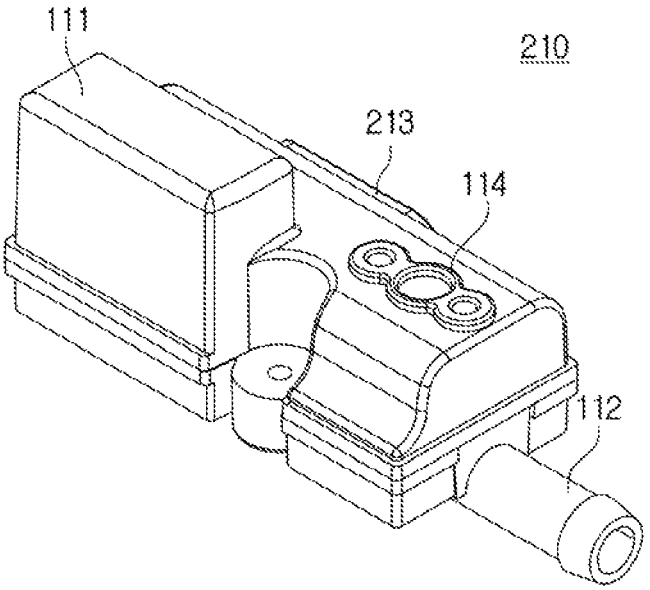
FIGS. 11 to 13 are views showing water supply devices and shown in FIG. 10.
Figure 12:
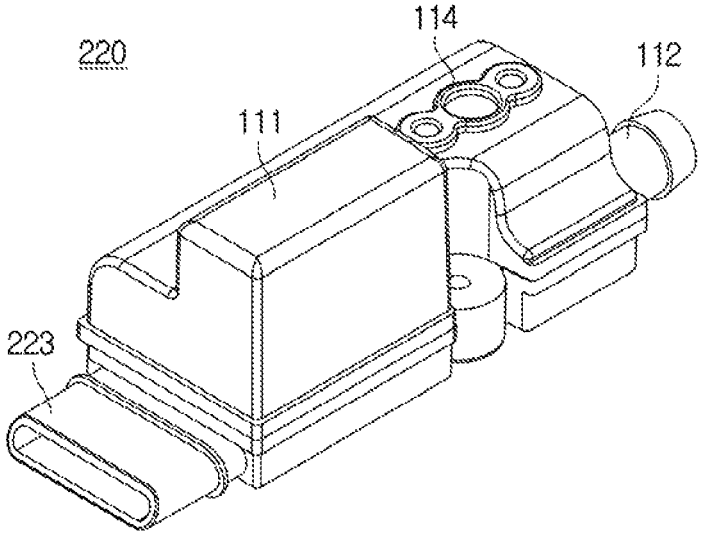
Figure 13:
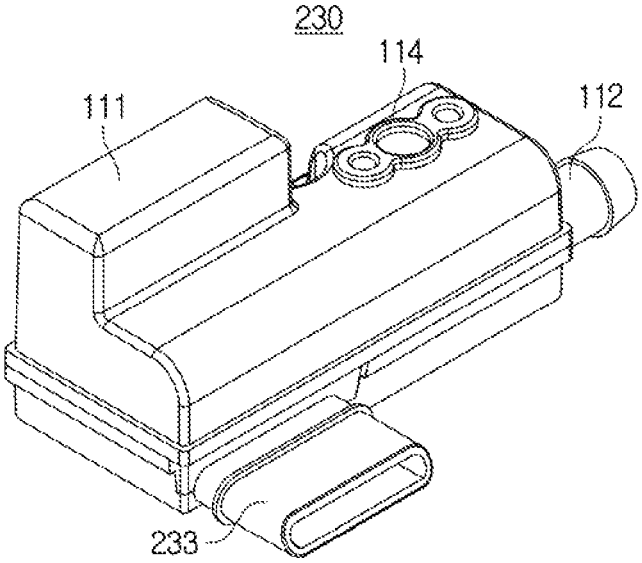

FIG. 10 is a view showing another embodiment of the water supply unit 100 shown in FIG. 1. FIGS. 11 to 13 are views showing water supply devices 210, 220, and 230 shown in FIG. 10.

The water supply devices 210, 220, and 230 of a washing machine 2 according to another embodiment of the present invention will be described with reference to FIGS. 10 to 13. However, the same components as those of the above-mentioned embodiments are denoted by the same reference numerals, and descriptions thereof will be omitted.

In the embodiment shown in FIG. 10, the water supply devices 210, 220, and 230 may be provided to be arranged in at least one position of a front portion, a rear portion, and a side portion of the auxiliary washing unit 51. The water supply devices 210, 220, and 230 are respectively arranged in the front portion, the rear portion, and the side portion in FIG. 10 for convenience of description, but the water supply devices may be arranged in only one position thereof.

As to the washing machine 2 shown in FIG. 10, the water supply devices 210, 220, and 230 are respectively arranged in the front portion, the rear portion, and the side portion of the auxiliary washing unit 51 so that washing water may be supplied to the auxiliary washing unit 51 in a large variety of directions, thereby improving water supply efficiency.

As the arrangement of the water supply devices 210, 220, and 230 is changed, an arrangement of outflow pipes 213, 223, and 233 is also changed. The water supply device 110 arranged at a side portion of the auxiliary washing unit 51 has the same configuration as that of the water supply device 110 shown in FIG. 6, and the description thereof will be omitted.

Referring to FIG. 11, when the water supply device 210 is provided in the front portion of the auxiliary washing unit 51, the inflow pipe 112 may be provided to be arranged in a direction substantially vertical to the outflow pipe 213.

Referring to FIG. 12, when the water supply device 220 is arranged in the rear portion of the auxiliary washing unit 51, the outflow pipe 223 may be provided to be arranged in a direction substantially opposite to a direction of the inflow pipe 112. That is, the outflow pipe 223 may be arranged to be in the same direction as a longitudinal direction of the housing 111.

Referring to FIG. 13, when the water supply device 230 is arranged at another side opposite to one side of the auxiliary washing unit 51 in which the water supply device 110 shown in FIG. 6 is arranged, the outflow pipe 233 may be provided to be arranged in a direction opposite to the outflow pipe 113 of the water supply device 110 shown in FIG. 6 while being arranged in a direction substantially vertical to the inflow pipe 112.

The direction of the outflow pipe has been described as above for convenience of description, but the present invention is not limited thereto. The direction of the outflow pipe with respect to the housing may vary depending on the arrangement of the water supply devices.

Figure 14:
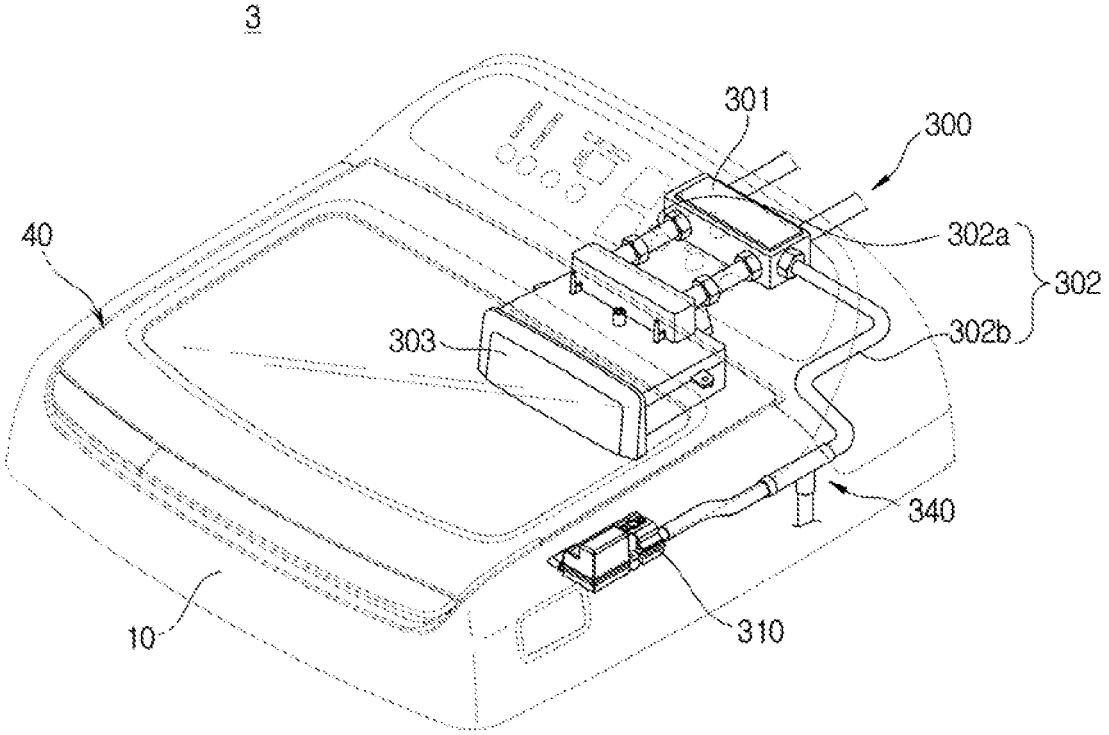
FIG. 14 is a view showing still another embodiment of the water supply unit shown in FIG. 1.
Figure 15:
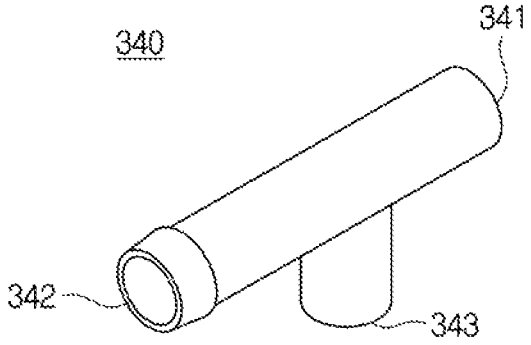
FIG. 15 is a perspective view showing a residual water drainage member shown in FIG. 14.
Figure 16:
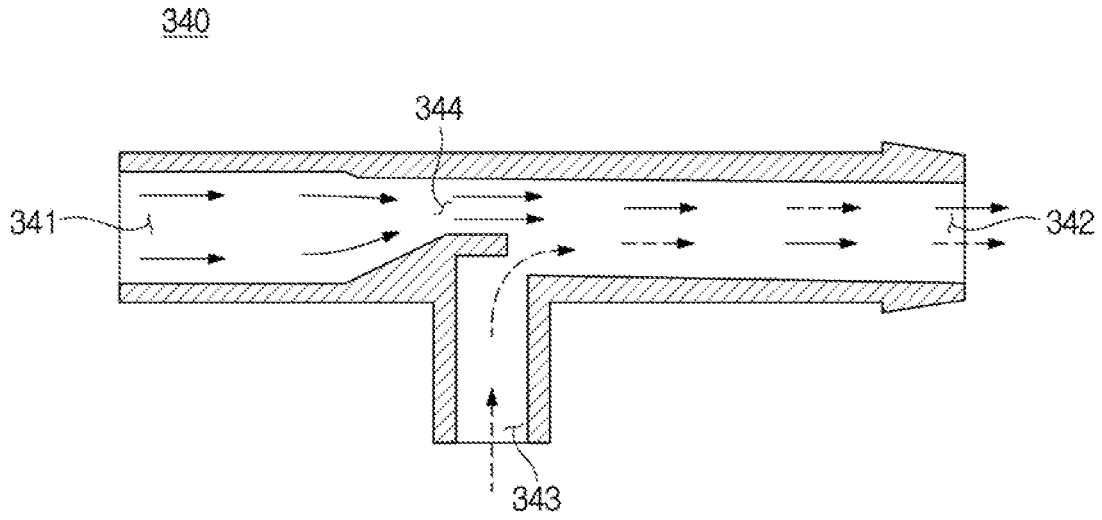
FIG. 16 is a cross-sectional view showing the residual water drainage member shown in FIG. 15.
Figure 17:
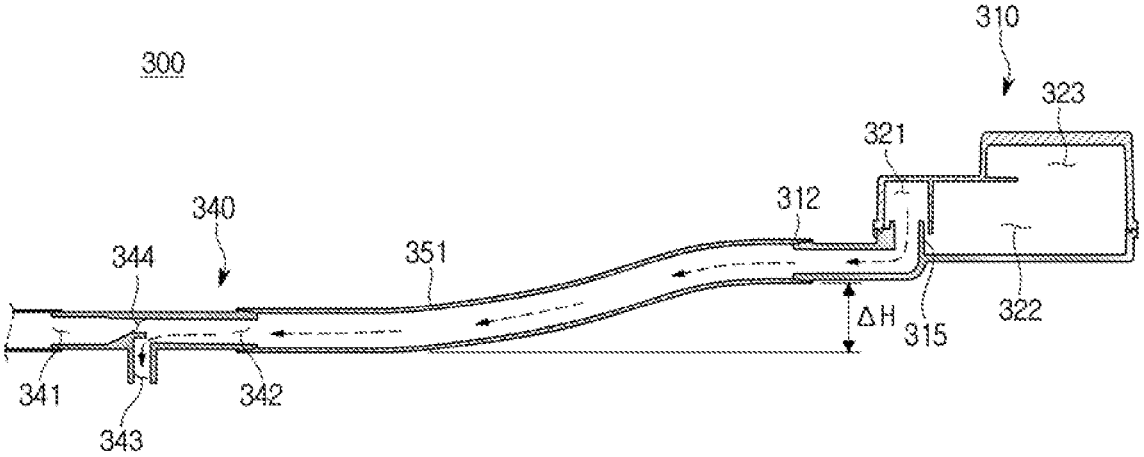
FIG. 17 is a cross-sectional view showing a connecting structure of the residual water drainage member shown in FIG. 14 and a water supply device.

FIG. 14 is a view showing still another embodiment of the water supply unit 100 shown in FIG. 1, FIG. 15 is a perspective view showing a residual water drainage member 340 shown in FIG. 14, FIG. 16 is a cross-sectional view showing the residual water drainage member 340 shown in FIG. 15, and FIG. 17 is a cross-sectional view showing a connecting structure of the residual water drainage member 340 shown in FIG. 14 and a water supply device 310.

A water supply unit 300 of a washing machine 3 according to still another embodiment of the present invention will be described with reference to FIGS. 14 to 17. However, the same components as those of the above-mentioned embodiments are denoted by the same reference numerals, and descriptions thereof will be omitted.

The water supply unit 300 according to the embodiment shown in FIG. 14 may include the residual water drainage member 340 provided on a flow passage through which washing water flows between the water supply valve 101 and the water supply device 310.

One end of the residual water drainage member 340 may be connected to the water supply valve 101, and the other end thereof may be connected to the water supply device 310. The residual water drainage member 340 may have a hollow portion formed therein, and may include a water supply hole 341 connected to the water supply valve 101, a main drainage hole 342 through which water introduced through the water supply hole 341 is discharged to the water supply device 310, and a residual water drainage hole 343 through which outside air is introduced when water is supplied and residual water existing in the water supply device is discharged when a supply of water is stopped.

The residual water drainage hole 343 of the residual water drainage member 340 may be provided in a direction perpendicular to a flow passage formed between the water supply hole 341 and the main drainage hole 342.

The residual water drainage member 340 may also include a venturi portion 344. The venturi portion 344 may be provided in the flow passage between the water supply hole 341 and the main drainage hole 342 so that a cross-sectional area of the flow passage is reduced, thereby increasing flow velocity of water flowing therein.

The residual water drainage hole 343 may be provided at a flow passage of the residual water drainage member 340 in which the venturi portion 344 is formed. That is, the residual water drainage hole 343 may be provided at a portion of the residual water drainage member 340 having the cross-sectional area that is reduced by the venturi portion 344. According to this configuration, when the residual water drainage member 340 supplies water, water introduced through the water supply hole 34 may be supplied to the water supply device 310 together with outside air introduced through the residual water drainage hole 343. Specifically, a flow velocity of flowing water is increased in accordance with a reduction in the cross-sectional area of the flow passage in the venturi portion 344, and thus, pressure may be reduced in the venturi portion 344 so that outside air may be introduced through the residual water drainage hole 343. Accordingly, the water supply device 310 may more readily form an air pocket capable of serving as a buffer when residual water is frozen.

The residual water drainage hole 343 may extend downward along the direction of gravity. Referring to FIG. 17, the residual water drainage member 340 may be provided at a side that is a preset height $\Delta H$ lower than the water supply device 310 along the direction of gravity.

Specifically, when the supply of water is stopped, washing water existing in the inflow chamber 321 of the water supply device 310 may flow through the inflow pipe 312 to a connection member 351 connecting the water supply device 310 and the residual water drainage member 340. The water passing through the connection member 351 may be discharged to the outside through the residual water drainage hole 343 that extends downward along the direction of gravity. At this point, all residual water inside the discharge chamber 322 cannot be discharged by an extension pipe 315, but an amount of the residual water remaining in the discharge chamber 322 is not an amount that is enough to cause freeze-breakage of the water supply device 310 even when the residual water is frozen in winter and increases in volume, and therefore is not a problem.

In addition, when the residual water drainage hole 343 is provided to communicate with the tub 11, the residual water may be discharged to the tub 11. That is, the residual water drainage hole 343 may be configured to discharge the residual water existing in the water supply device 310 to the main washing space 11*a* when the supply of water is stopped. Accordingly, it is possible to prevent waste of the washing water.

Accordingly, the residual water drainage hole 343 may discharge residual water remaining in the water supply device 310 without any separate driving source when the supply of water is stopped.

According to the above-described structure, in the washing machine 3 according to still another embodiment of the present invention, it is possible to prevent freeze-breakage of the water supply device 310 due to volume expansion of residual water even when the residual water existing inside the water supply device 310 is frozen in winter.

As described above, the washing machines 1, 2, and 3 according to the embodiments of the present invention may form air pockets in the water supply devices 110, 210, 220, 230, and 310 to prevent freeze-breakage of the water supply devices 110, 210, 220, 230, and 310, and the washing machine 3 may drain residual water existing in the water supply device 310 through the residual water drainage member 340 to prevent freeze-breakage of the water supply device 310.

According to the spirit of the present invention, since the buffer chamber in which an air pocket is formed is provided, freeze-breakage of the water supply device due to frozen residual water may be prevented even when residual water existing inside the water supply device is frozen and increases in volume.

According to the spirit of the present invention, since the water supply device may discharge residual water existing therein in a relatively simple structure when a supply of water is stopped, freeze-breakage of the water supply device due to frozen residual water may be prevented.

Although a few embodiments of the present disclosure have been shown and described, it should be appreciated by those skilled in the art that changes may be made in these embodiments without departing from the principles and spirit of the disclosure, the scope of which is defined in the claims and their equivalents.

What is claimed is:

1. A water supply device comprising:

a housing that has an inlet and an outlet;

an inflow chamber that is provided inside the housing and communicates with the inlet;

a discharge chamber that is provided inside the housing and communicates with the inflow chamber through a discharge chamber inlet and communicates with the outlet;

a buffer chamber that is provided inside the housing and communicates with the discharge chamber, so that an air pocket is formed in the buffer chamber when supply of water to the inflow chamber is stopped; and a blocking rib that extends horizontally away from the discharge chamber inlet from a surface of the housing downstream of the discharge chamber inlet and above the discharge chamber inlet to define the buffer chamber between the blocking rib and a portion of an upper surface of the housing and to define the discharge chamber between the blocking rib and a lower surface of the housing.

2. The water supply device according to claim 1, wherein the blocking rib extends from an inner side of the housing that is adjacent to the inflow chamber.

3. The water supply device according to claim 1, wherein at least one end portion of the blocking rib is spaced apart from an inner surface of the housing to form a buffer hole through which the discharge chamber and the buffer chamber communicate.

4. The water supply device according to claim 1, wherein the blocking rib is provided to limit a volume of residual water remaining inside the discharge chamber when the supply of water to the water supply device is stopped.

5. The water supply device according to claim 1, wherein the blocking rib is provided to extend along a direction perpendicular to a direction of gravity.

6. The water supply device according to claim 1, wherein the buffer chamber is provided at an upper portion of the discharge chamber along a direction of gravity.

7. The water supply device according to claim 1, further comprising:

a water pressure adjusting rib that extends from the inner side of the housing and is provided to partition the inflow chamber from the discharge chamber.

8. The water supply device according to claim 7, wherein the water pressure adjusting rib is spaced apart from a lower surface of the housing to form a water pressure adjusting hole through which the inflow chamber and the discharge chamber communicate.

9. The water supply device according to claim 7, wherein the water pressure adjusting rib includes an air pocket hole that is formed to pass therethrough so that a part of the air pocket formed in the buffer chamber is moved to the inflow chamber.

10. The water supply device according to claim 9, wherein the air pocket hole includes a plurality of slits.

11. The water supply device according to claim 1, wherein an outlet guide rib is provided at the outlet, the outlet guide rib extends along a discharge direction of water and guides water discharged from the discharge chamber.

12. A water supply device comprising:

a housing that has an inlet and an outlet;

an inflow chamber that is provided inside the housing and communicates with the inlet;

a discharge chamber that is provided inside the housing and communicates with the inflow chamber through a discharge chamber inlet and communicates with the outlet;

a buffer chamber that is provided inside the housing and communicates with the discharge chamber, the buffer chamber extending above the discharge chamber so that an air pocket is formed above the discharge chamber when supply of water to the inflow chamber is stopped;

a blocking rib that extends horizontally away from the discharge chamber inlet from a surface of the housing downstream of the discharge chamber inlet and above the discharge chamber inlet to define the buffer chamber between the blocking rib and a portion of an upper surface of the housing and to define the discharge chamber between the blocking rib and a lower surface of the housing; and a water pressure adjusting rib that extends vertically from an upper surface of the housing opposite to the inlet to define the inflow chamber between a side of the housing and the water pressure adjusting rib and to further define the discharge chamber between another side of the housing and the water pressure adjusting rib, wherein the water pressure adjusting rib includes an air pocket hole through which the discharge chamber and the inflow chamber communicate.

13. A washing machine comprising:

a cabinet;

a main washing space that is provided inside the cabinet and has a tub in which washing water is stored and a rotating tub in which laundry is disposed inside the tub;

an auxiliary washing space that is provided to be separate from the main washing space; and a water supply device that supplies washing water to the auxiliary washing space, wherein the water supply device includes a housing that has an inlet and an outlet and includes an inflow chamber communicating with the inlet, a discharge chamber communicating with the inflow chamber through a discharge chamber inlet and communicating with the outlet, and a buffer chamber communicating with the discharge chamber and the outlet, wherein the outlet is configured to supply the washing water to the auxiliary washing space, a blocking rib extending horizontally away from the discharge chamber inlet from a surface of the housing downstream of the discharge chamber inlet and above the discharge chamber inlet to define the buffer chamber between the blocking rib and a portion of an upper surface of the housing and to define the discharge chamber between the blocking rib and a lower surface of the housing, and a water pressure adjusting rib extending vertically from an upper surface of the housing opposite to the inlet to define the inflow chamber between a side of the housing and the water pressure adjusting rib and to define the discharge chamber between another side of the housing and the water pressure adjusting rib, and in which an air pocket hole is formed so that the inflow chamber and the discharge chamber communicate.

14. The washing machine according to claim 13, wherein the water pressure adjusting rib is spaced apart from a lower surface of the housing to form a water pressure adjusting hole provided to move water introduced through the inlet from the inflow chamber to the discharge chamber.

15. The washing machine according to claim 13, wherein the water supply device is configured to be supplied with water from a water supply source, and further comprising a residual water drainage member that is provided at a flow passage between the water supply source and the water supply device and in which a residual water drainage hole is formed for discharging residual water existing in the water supply device when the supply of water is stopped.

16. The washing machine according to claim 15, wherein the residual water drainage member is disposed at a position lower than that of the water supply device in a direction of gravity.

17. The washing machine according to claim 15, wherein the residual water drainage member includes an inflow pipe through which water is introduced from the water supply source and an outflow pipe through which the water introduced through the inflow pipe is discharged to the water supply device, and the residual water drainage hole is provided at a flow passage between the inflow pipe and the outflow pipe.

18. The washing machine according to claim 17, wherein the residual water drainage member includes a venturi portion in which a cross-sectional area of the flow passage is reduced, and the residual water discharge hole is formed at a portion of the residual water drainage member at which the venturi portion is formed.

19. The washing machine according to claim 18, wherein the residual water drainage member supplies water passing through the venturi portion together with outside air introduced through the residual water drainage hole to the water supply device when supplying water.

20. The washing machine according to claim 15, wherein the residual water drainage hole is configured to discharge the residual water existing in the water supply device to the main washing space when the supply of water is stopped.

* * * * *